US008596352B2

(12) United States Patent
Rybakov

(10) Patent No.: US 8,596,352 B2
(45) Date of Patent: Dec. 3, 2013

(54) METHODS OF INCREASING OR ENHANCING OIL AND GAS RECOVERY

(75) Inventor: Alexandr Rybakov, Moscow (RU)

(73) Assignee: Oil Recovery Technology Holdings, LLC, New York, NY (US)

( * ) Notice: Subject to any disclaimer, the term of this patent is extended or adjusted under 35 U.S.C. 154(b) by 392 days.

(21) Appl. No.: 12/803,274

(22) Filed: Jun. 24, 2010

(65) Prior Publication Data

US 2011/0315374 A1 Dec. 29, 2011

(51) Int. Cl.
*E21B 43/16* (2006.01)

(52) U.S. Cl.
USPC ..... 166/248; 166/245; 166/268

(58) Field of Classification Search
USPC ..... 166/248, 268, 245
See application file for complete search history.

(56) References Cited

U.S. PATENT DOCUMENTS 4,499,948 A * 2/1985 Perkins ..... 166/248

* cited by examiner

*Primary Examiner* — Brad Harcourt
(74) *Attorney, Agent, or Firm* — Galvin & Palmer; Sheldon Palmer

(57) ABSTRACT

Disclosed are methods for enhancing the productivity of oil wells involving the introduction of specifically determined amounts of pulsed electrical stimulation to the well reservoir by applying electrical current thereto through the well head and well casing for predetermined amounts of time.

6 Claims, 2 Drawing Sheets

METHODS OF INCREASING OR ENHANCING OIL AND GAS RECOVERY

CROSS-REFERENCE TO RELATED APPLICATIONS

Not Applicable

STATEMENT REGARDING FEDERALLY SPONSORED RESEARCH OR DEVELOPMENT

Not Applicable.

THE NAMES OF THE PARTIES TO A JOINT RESEARCH AGREEMENT

Not Applicable

INCORPORATION-BY-REFERENCE OF MATERIAL SUBMITTED ON A COMPACT DISC

Not Applicable

REFERENCE TO A MICROFICHE APPENDIX

Not Applicable

BACKGROUND OF THE INVENTION

1. Field of the Invention

The present invention relates to the oil production industry, more specifically, methods for reducing flooding of the produced fluid from producing wells, and increasing or enhancing oil productivity of producing wells by electrical stimulation of the underlying oil reservoir. It is well known that as the world price of oil fluctuates, certain oil wells become either economical or uneconomical to operate because the cost of recovering the oil from the oil field may either be too expensive (if the price of oil is low) or it may be economically practical to recover as the price of oil goes up. In recent years, due to political considerations as well as increased worldwide demand for oil from previously underdeveloped countries, the price of oil has generally been increasing; at times, to a level where previously unworked wells become profitable again. Thus, as previously unprofitable wells reach a point where, based on the increase in the price of oil, they now become suitable candidates for being worked again, there is a need in the industry to provide methods for increasing or enhancing the rate of recovery of oil from such wells.

2. Description of Related Art

There are a number of known methods for enhancing the productivity of oil wells that are either relatively depleted, or which are not economically feasible to work based on the cost of working the wells relative to the market price of oil at any particular point in time. U.S. Pat. No. 2,799,641 (Bell), U.S. Pat. No. 3,948,319 (Pritchett) and U.S. Pat. No. 6,199,634 (Selyakov); Russian Patents Nos. 2209301, 2211919, 2239697, 2267008, 2344275, and WO Patent No. 92123326 are relevant prior art.

The Bell '641 patent which discloses a method of promoting oil flow to the well involves passing a direct or pulsating current for electrolytic movement of the oil flow to the well through the underlying geologic formation. However, Bell does not address the problem of reducing the water cut, or content of the extracted fluid, the improvement in the amount of recoverable oil in the formation, the improvement of, and efficiency of the electrical impact on the formation, and simply lists several methods of electrolytic action. The Pritchett '319 patent which discloses a method and apparatus for stimulating oil production involves passing a multiphase current through several neighboring (adjacent) wells by means of electric heating of the geological formation. However, Pritchett does not teach or suggest how the problem of reduction of the water cut of the extracted fluid, improvement of recoverable oil in the formation, improvement of efficiency of the electric impact on the formation may be achieved, but merely lists a number of options for heating the oil formation.

The Selyakov '634 patent which discloses a method and apparatus for improving oil production involves stimulating a well by electric downhole heating, which improves the permeability of the geologic formation. However, Selyakov does not teach, suggest or disclose actual exact working, reproducible methods of reducing the water cut of the extracted fluid, an improvement of recoverable oil from the formation, an improvement in the efficiency of the electrical impact on the formation, but rather, simply lists a number of options for the application of the electric downhole heating and provides no evidence of the effectiveness of using his method.

Additionally, the Abdulmanov, et al. Patent PCT/SU91/00079 which discloses a method of fluid production stimulation through management of the wellbore zone Permeability involves selecting a critical value for the current density when passing the current through the wellbore zone with the objective of improving the fluid extraction. However, this method does not disclose using it at an oil well, the reduction of the water cut of the extracted fluid, reservoir recovery improvement, or any improvement in efficiency of the electric impact on the formation, and simply lists numerous options for managing the wellbore zone permeability.

Kalmykov, (Publication number RU2211919 (C2), 2001) which discloses a method of well recovery improvement involves the use of electric impact on well filter zones, specifically, using bipolar current pulse trains with pauses between the trains based on a prior determination of the impulse capacity to improve the production of water and oil wells. However, this method does not resolve the problems of reducing the water cut of the extracted fluid, reservoir recovery improvement, or improvement of efficiency of the electric impact on the formation.

Rybakov et al. (RU 2 344 275, 2007) discloses a method of stimulation of intensification of water extraction from the groundwater horizons through clogged wells. Another known method for optimizing production optimization and increase in productivity of oil and gas fields is disclosed in Russian Patent (RU 2209301), wherein in order to reduce water flooding in the produced fluid and increase current oil production, as well as increasing oil recovery of the layer, a fluid is pumped out of the producing reservoir and the latter is subject to electrical stimulation using heteropolar pulse current. However, this method is limited to only sequential electrical treatment of the most flooded wells (in fact, those in late stage of development). The method does not provide for the possibility of an increase in optimization of the oil field development by conducting parallel electrical treatment of the wells undergoing different stages of development. Additional screening of the wells is limited by only one criterion. No estimates of the specific parameters of the electrical treatment of the wells are provided, and thus, the effectiveness of the method is speculative at best. The method does not describe how to monitor the duration of the electrical pulse during different stages of the electrical treatment of the well.

The closest art of all to the present method is the method for enhancing reservoir oil recovery (Russian Patent Application No. 2007101698, Reg. Number 001817 of Jan. 18, 2007). The invention disclosed therein relates to methods of reducing flooding of the produced fluid and restoring oil productivity of producing wells by electrical stimulation of the oil reservoir via these producing wells.

In this method, three oil field sites undergoing late, early or intermediate stages of development are selected for parallel electric stimulation of the oil reservoir; however the criteria for selection of wells on each of these three sites is not particularly adequate or accurate, while at the same time, the disclosed mathematical formulae for doing so are quite general and lack suitable accuracy to enable the process to effectively enhance productivity. Moreover, the calculations of pulse duration according to the aforesaid formulae at various stages in the electrical stimulation are not accurate either. This method does not provide a sufficient improvement in the success rate of electrical treatment of wells due to the inadequate selection of wells on the three mentioned oil field sites. This is because of a failure to take into account the possibility of water "finger" breakthroughs (the potential difference between the average permeability of the reservoir and the permeability of its highly permeable sublayers which may differ by several orders of magnitude.) and no taking into account the possibility of cross-flow from the water-bearing horizons (predominantly, in the case of insufficient cementation of the casing shaft of the well). In essence, this method does not provide sufficient improvement in the effectiveness of the electrical treatment of the wells because of an inaccurate calculation of the pulse duration at various stages of the electrical treatment. Specifically, the key parameter in the disclosed formulae is not the mean pore radius, but rather, some minimal pore radius. Essentially, the method is ineffective because it is based on incorrect mathematical parameters and formulae based on those parameters.

BRIEF SUMMARY OF THE INVENTION

The enhancement of the productivity of oil wells is effected by selective screening of potential wells for electrical treatment (electrostimulation) of the underlying oil reservoir wherein the electrostimulation is performed on currently producing wells following a pattern, including the degree or amplitude of the electric stimulation, the duration of the stimulation and the periods of time between sequential pulses of stimulation and finally, the cessation of the electric stimulation, all determined from specific mathematical criteria as described below.

DETAILED DESCRIPTION OF THE INVENTION

Figure 1:
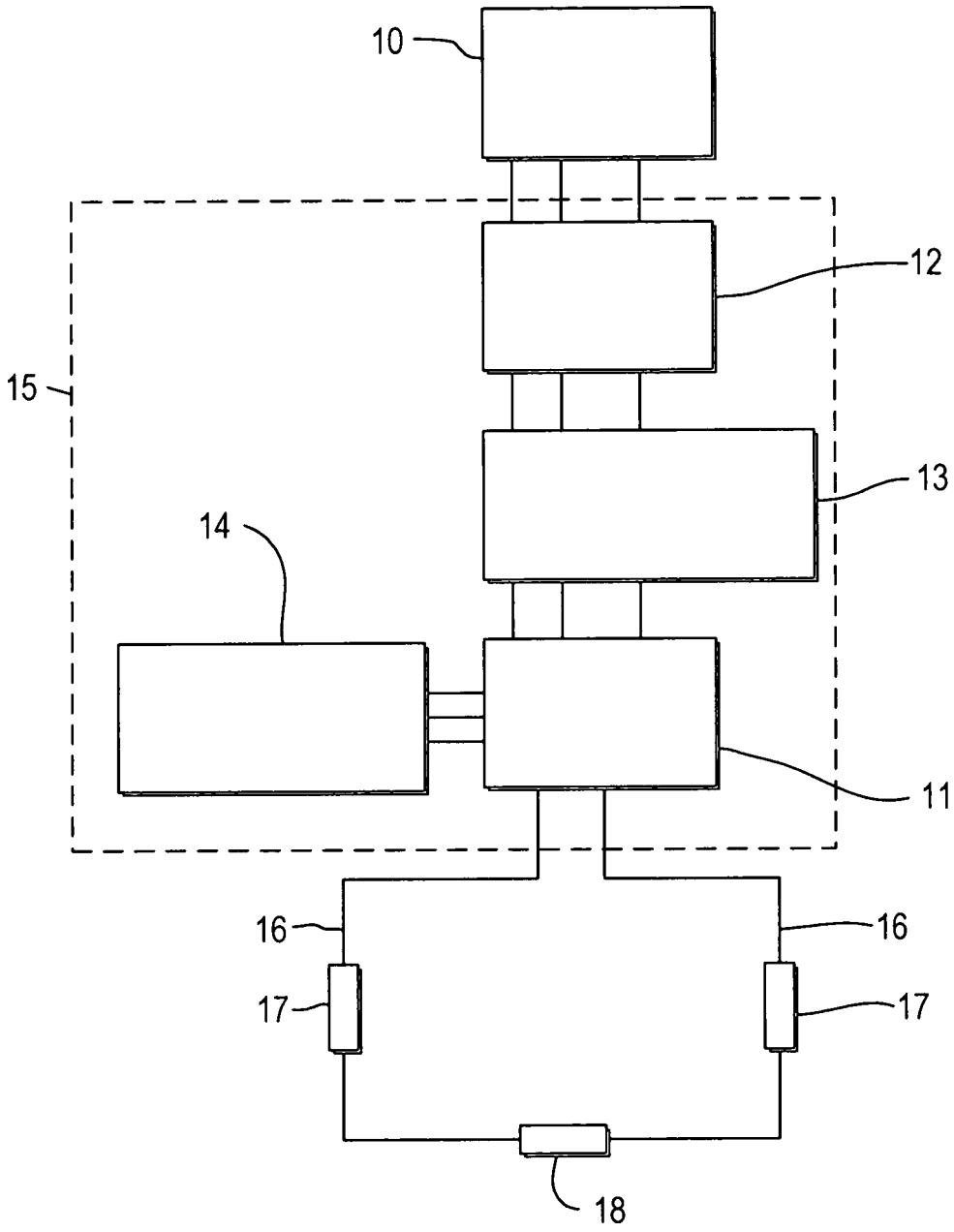
FIG. 1 is a block diagram illustrating the various elements of the electrical treating equipment used in the method of the invention and their physical relationship to the wells and oil reservoir being treated.

As shown in FIG. 1, a 3 phase diesel generator 10 which is the source of the electrical energy used in performing the method of the invention, is connected to a power supply unit 11, through circuit breaker 12 (a fail safe to shut down the entire system in case of an overload or other technical difficulty) and transformer 13, the operation of all of which is controlled by a conventional computerized control box 14. The technician or engineer controlling the method using control box 14 is able to set, adjust, control and maintain the strength and duration of the electrical pulses. All of the aforementioned elements are contained within a mobile vehicle 15 (shown in block form and enclosed within dotted lines) which can be moved from place to place in order to perform the method of the invention in different locations as desired. Shown coming out of the vehicle 15 from the power supply unit 11 are electrical cables 16. The cables are connected to the flanges of the casings 17 of the oil wells (casings of the wells are used as electrodes), where the current is applied as needed and as dictated by the particular parameters of the wells being treated.

Figure 2:
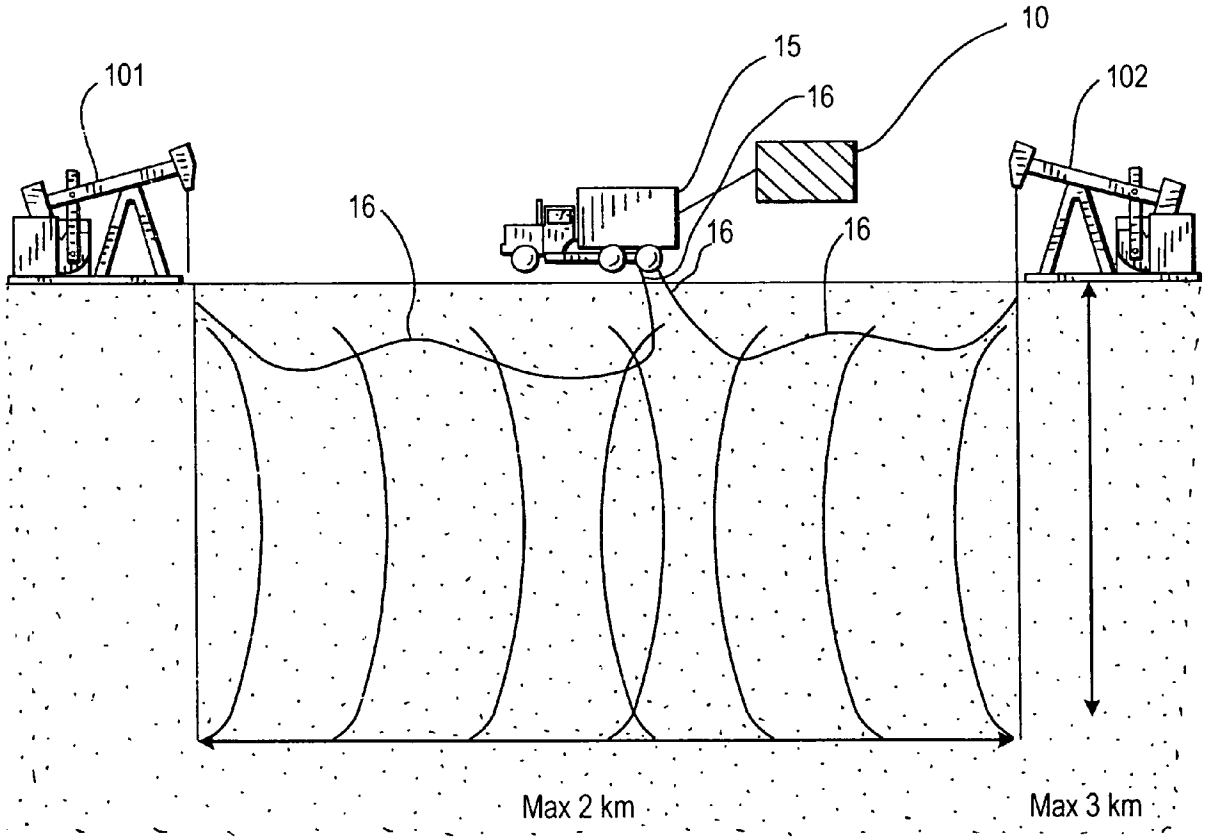
FIG. 2 is a representation showing the physical location of the electrical treating equipment relative to a pair of wells being treated according to the method of the invention.

As shown in stylized fashion in FIG. 2, a typical well site being treated comprises 2 wells 101 and 102, of about a maximum depth of 3 km and separated by no more than about 2 km. in distance from one another are being treated with electrical pulses from diesel generator 10 by means of cables 16 coming from and controlled by the devices described above with respect to FIG. 1 in mobile vehicle 15.

After the selection process for the wells to be treated is completed in accordance with the foregoing parameters, the mobile vehicle 15 (with diesel generator 10 connected thereto) is delivered to the site, where the electric treatment of oil wells is to be performed. Fences/warning signs are erected as dictated by law/safety concerns and then, as shown in FIG. 1, all electrical cables, i.e. power, grounding and earth are connected.

At this point, the pumping of the oil wells to be treated (1 or 2) is discontinued including disconnecting the oil wells from the oil collector tubes, after which the wells are connected to the power chain. At the conclusion of the electrical treatment of the wells (described below) all the prior connections are restored. The electrical lines are disconnected, and the oil wells are put back into pumping operation.

In effecting the electrical treatment after disconnecting the wells and before reconnecting them, the technician or engineer conducts calculations of the parameters for the electrical treatment in accordance with the provided formulas.

The duration of the electrical pulse during the first stage is maintained at the following level: $T_{cl}=R_{cl}/4*\alpha$, where $R_{cl}=Rm/2$ and Rm is the average pore radius in the bottom-hole zone rock (determined using a bore specimen from the bottom-hole zone), $\alpha=Y_{cl}/c_v*\rho$, where $Y_{cl}$ is the coefficient of thermal conductivity of the colmatant under the reservoir conditions, $c_v$ is the specific heat of the colmatant under the reservoir conditions, and $\rho$ is the density of the colmatant under the reservoir conditions; the duration of the pause should not be less than the duration of the pulse, at maximum amplitude of the pulse. The word "colmatant" is a well-known term of art, especially in the petroleum and other drilling fields. While it is a French word, i.e., the present participle of the French verb "colmater", it is well understood by those skilled in the art to mean clogging, plugging or sealing [of the well column]. Annexed as collective Ehibit A are printouts from the results of a number of online Google searches for the term "colmatant" which establish the aforesaid meaning(s) of the term.

Electrical treatment of the reservoir is continued until the pulse current amplitude reaches its maximum (500-5000 A), and its time derivative reaches zero ($I_a/dt=0$). The duration of the electrical pulse during the subsequent period of treatment is maintained at the following level: $T_g=R^2_g/\alpha=R^2_a/4\alpha_\Psi$, where $R_g=R_a/2$ and $R_a$ is the average radius of pores through which filtration in a given oil reservoir proceeds, $\alpha_\Psi$ is the thermal diffusivity of the reservoir water in the oil reservoir rock, $\alpha_\Psi=Y_w/c_\Psi*\rho_\Psi$, where: $Y_w$ is the coefficient of thermal conductivity of the reservoir water under the reservoir conditions, $c_{p\text{-}}$ is coefficient of the specific heat of the reservoir water under the reservoir conditions, and $\rho_{\text{-}}$ is the density of the reservoir water under the reservoir conditions; the duration of the pause should not be less than the duration of the pulse, at maximum amplitude of the pulse.

The electrical treatment is discontinued once the decrease of amplitude of the pulse is observed (in the example below 1900 A after the maximum 2000 A).

Data obtained from experimental tests of the present method have confirmed the success rate and effectiveness of the method, specifically with respect to an increase in oil production rate, a decrease in the flooding of the produced fluid, and the amount of the additionally produced oil.

As will be clear from the following description, in carrying out the method of the invention, it is important to effect enhancement of oil recovery from the treated well or wells. This is achieved by the effective use of electrical treatment or stimulation of the oil reservoirs. This effect is achieved in the present method for improving reservoir recovery, by using a more rational basis (as compared with the prior art) for screening of wells for electrical treatment of the reservoir, while the electrical treatment itself using producing wells is applied based on more adequate and optimized electrical stimulation pulse durations at various stages of the reservoir treatment. More specifically, electrical stimulation of the oil reservoir using producing wells is conducted in parallel on three sites of the oil or oil and gas field, and specifically a) at a first site in the oil field undergoing late stage development for resuscitation using wells that are approaching a margin of profitability due to a high level of flooding of the produced fluid, followed by treatment of wells which have already stopped producing due to lack of profitability caused by a high level of flooding, but which have not yet been rigged down, or capped; b) at a second site in the oil field undergoing early stage development, for preventing and constraining rapid flooding of the produced fluid by serial, gradual treatment of the wells starting with those having the highest level of flooding of the produced fluid and the highest fluid production rate; and c) at a third site of the oil field, being between the first and second sites, for maximum constraint of rapid flooding of the field by serial, gradual treatment of the wells, starting with those having the maximum rate of flooding of the produced fluid and the highest fluid production rates.

The above described sequence of parallel treatment on 3 sites of the oil field prevents the elimination of some wells approaching a profitability margin by returning them into the profitable area of operation; provides the most effective reduction in flooding of the produced fluid, ensures an increase in current oil production and increase in reservoir recovery. Thus, an essential difference between the present method and the prior methods lies in the performance of parallel electrical treatments on 3 sites of the oil field undergoing early, intermediate and late stages of development. This is done by a procedure wherein the selection of wells for electrical stimulation in the three said sites is conducted in such a way that the list of wells selected for treatment excludes a) wells with highly non-uniform permeability in the oil reservoir cross-section as compared to those wells with minimal non-uniform permeability in the oil reservoir cross-section, where the water "finger" breakthrough from the nearest injection wells to the one in question has already occurred; b) wells with a greater relative inflow rate of the reservoir fluid in the most permeable sublayer of the producing reservoir, as determined by the equation: $q=Q_{ni}/H$, where q is linear well late in the most permeable part of the layer (one unit of the part of the layer to one meter), $Q_{ni}$ is the fluid flow rate (determined using porometry of a specified well) through the most permeable sublayer of the producing reservoir from the injection wells to the well in question, H is the capacity (in meters) of the most permeable part of the layer (the maximum permeability); c) wells with the maximum relative cross-flow rate of the reservoir water through a cone in the bottom of the reservoir, i.e., with large relative excess of the production rate limit as compared to the well with the minimal relative excess, in which the reservoir water breakthrough to the perforation interval on the casing column along the cone through the bottom of the reservoir has already taken place, and where the production rate limit is calculated based on the equation: $Q_{pr}=0.0033*k_0*(\rho_{\text{-}}-\rho_0)*Q/\mu_0*B$, where: $k_0$ is the oil permeability coefficient, $(\rho_{\text{-}}-\rho_0)$ is the difference of water and oil densities, Q is a tabulated value of the production rate, $\mu_0$ is the absolute oil viscosity coefficient, B is the oil volumetric coefficient used to convert the volume of oil under reservoir conditions to volume under surface conditions; and d) wells with high relative cross-flow rate of the reservoir water from the adjacent (above the roof of the reservoir) of the water-bearing horizon into the producing reservoir, estimated based on the relative concentration of ions, originally contained only in the water-bearing horizon, when the average concentration of such ions in the producing reservoir increases by 10% with respect to their concentration in the water-bearing horizon. This sequence of well selection ensures higher success rate and effectiveness of electrical treatment of the reservoir using wells as thus selected.

Also of great significance to the efficacy of the present method is the duration of the electrical pulse applied to the reservoir. The duration of the electrical pulse during the first stage is maintained at the following level: $T_{cl}=R^2_{cl}/\alpha=R^2_m/4\alpha$, where $R_{cl}=R_m/2$ and $R_m$ is the average pore radius in the bottom-hole zone rock (determined using a bore specimen from the bottom-hole zone), $\alpha=Y_{cl}/c_v*\rho$, where $Y_{cl}$ is the coefficient of thermal conductivity of the colmatant under the reservoir conditions, $c_v$ is the specific heat of the colmatant under the reservoir conditions, and $\rho$ is the density of the colmatant under the reservoir conditions.

Electrical treatment of the reservoir is continued until the pulse current amplitude reaches its maximum, and its time derivative reaches zero ($dI_a/dt=0$).

The duration of the electrical pulse during the subsequent period of treatment is maintained at the following level: $T_g=R^2_g/\alpha=R^2_a/4\alpha_\Psi$, where $R_g=R_a/2$ and $R_a$ is the average radius of pores through which filtration in a given oil reservoir proceeds, $\alpha_{\text{-}}$ is the thermal diffusivity of the reservoir water in the oil reservoir rock, $\alpha_{\text{-}}=Y_w/c_{\text{-}*\rho\text{-}}$, where: $Y_w$ is the coefficient of thermal conductivity of the reservoir water under the reservoir conditions, $c_{p\text{-}}$ is the specific heat of the reservoir water under the reservoir conditions, and $\rho_{\text{-}}$ is the density of the reservoir water under the reservoir conditions.

The electrical treatment is discontinued once the pulse current amplitude has decreased to not less than 10% of the maximum value.

The formulae given above for determining pulse duration during the electrical treatment ensure more significant (as compared to prior methods) reduction in flooding of the produced fluid as well as increase in reservoir oil recovery, i.e., provide significant increase in effectiveness of electrical treatment of the wells.

Effecting the method of the invention thus requires a more thorough preliminary screening of wells for electrical treatment without including wells at maximum risk of flooding as a result of water "finger" breakthroughs along the reservoir, water breakthroughs through the water cones and through the bottom of the reservoir, water breakthroughs along the column from the water-bearing horizon, optimized sequence of electrical treatment conducted in parallel on 3 field sites undergoing early, late and intermediate (more rapidly flooded) stages, with wells carefully selected for electrical treatment on each of the sites; more adequate and accurate calculation of pulse duration during various stages of electrical treatment as a result of electrical treatment of the producing (operational) oil wells, which lead to a significant increase in effectiveness and reservoir oil recovery. Well test data confirm a considerable improvement in the success rate and effectiveness of the method, and specifically with respect to increase in oil production rate, decrease in flooding of the produced fluid and the amount of additionally produced oil.

EXAMPLES

Example 1

The method of the invention was applied to 6 wells in the Zyuzeyevskoye region oil field. The success rate was 100%. That is, in each well treated according to the invention, there was observed significant improvement in the yield from the wells. The basic parameters of one of the wells in this field (No. 2345) were as follows: water content=93%, oil production rate=1.8 ton/day. The parameters of well No. 2345 three months after the electrical treatment were: water content=58.5%, oil production rate=14.1 $m^3$/day. Electrical stimulation parameters: supplied power P=280 kW, pulse voltage amplitude U=180 V, current amplitude $I_{max}$=4,200 A, pulse duration: 25 ms, pulse ratio: 2. Electrical stimulation stopped at I=3,800 A.

Example 2

In November 2009, an experimental electric treatment of an oil reservoir involving well No. 13108 was conducted in the Arlansk field, Kashiro-Podolsk reservoir using the present method. The basic oil well characteristics (in relation to base level) were as follows: the water content in the produced liquid was 97.6% and the oil production rate was 0.22 ton/day. Electrical stimulation parameters for this electrical treatment were as follows: supplied power P—125 kW, pulse voltage amplitude U=170 V, current amplitude Imax=2000 A, pulse duration Ti1=40 ms, pause , Ti2=50 ms, pause=55 ms. Electrical stimulation stopped at I=1800 A. In March 2010, four months after experimental treatment was conducted on the reservoir, using the aforementioned well, the characteristics of the oil well were as follows: the water content in the produced liquid was reduced to 92.7% and the oil production rate was increased to 0.70 ton/day.

The invention claimed is:

1. A method for enhancing the oil recovery and productivity of an oil reservoir comprising pumping produced fluid out of the producing reservoirs using producing wells, each of said wells having a mouth and a metallic casing column through which oil is delivered from the reservoir to the surface, and applying electrical stimulation in the form of a multidirectional pulse current to the reservoirs through the said mouth and the metallic casing columns of the well being treated, wherein, in order to increase the effectiveness of the treatment, the electrical stimulation of the oil reservoir using producing wells is conducted in parallel on three sites of the oil or oil and gas field, and specifically:

a) at a first site in the oil field undergoing late stage development for resuscitation using wells that have not already stopped producing due to a lack of profitability due to a level of flooding of the produced fluid higher than those starting with treatment of wells which have already stopped producing due to lack of profitability caused by a high level of flooding, but which have not yet been capped;

b) at a second site in the oil field undergoing early stage development, for preventing and constraining flooding of the produced fluid by serially treating the wells sequentially in order; starting with those having the highest level of flooding of the produced fluid and the highest fluid production rate; and c) at a third site of the oil field, being between the first and second sites, for maximum constraint of flooding of the field by serial, gradual treatment of the wells, starting with those having the maximum rate of flooding of the produced fluid and the highest fluid production rates;

and wherein the selection of wells for electrical stimulation in the three said sites is conducted in such a way that the list of wells selected for treatment excludes a) wells with highly non-uniform permeability in the oil reservoir cross-section as compared to those wells with minimal non-uniform permeability in the oil reservoir cross-section, where the water "finger" breakthrough from the nearest injection wells to the one in question has already occurred;

b) wells with a greater relative inflow rate of the reservoir fluid in the most permeable sublayer of the producing reservoir, as determined by the equation:

$q=Q_{ni}/H$, where q is linear well late in the most permeable part of the layer (one unit of the part of the layer to one meter), $Q_{ni}$ is the fluid flow rate (determined using porometry of a specified well) through the most permeable sublayer of the producing reservoir from the injection wells to the well in question, H is the capacity of the most permeable part of the layer (the maximum permeability);

c) wells with the maximum relative cross-flow rate of the reservoir water through a cone in the bottom of the reservoir, i.e., with large relative excess of the production rate limit as compared to the well with the minimal relative excess, in which the reservoir water breakthrough to the perforation interval on the casing column along the cone through the bottom of the reservoir has already taken place, and where the production rate limit is calculated based on the equation:

$Q_{pr}=0.0033*k_0*(\rho_\Psi-\rho_0)*Q/\mu_0*B$, where: $k_0$ is the oil permeability coefficient, $(\rho_\Psi-\rho_0)$ is the difference of water and oil densities, Q is a tabulated value of the production rate, $\mu_0$ is the absolute oil viscosity coefficient, B is the oil volumetric coefficient used to convert the volume of oil under reservoir conditions to volume under surface conditions; and d) wells with high relative cross-flow rate of the reservoir water from the adjacent (above the roof of the reservoir) of the water-bearing horizon into the producing reservoir, estimated based on the relative concentration of ions, originally contained only in the water-bearing horizon, when the average concentration of such ions in the producing reservoir increases by 10% with respect to their concentration in the water-bearing horizon.

2. A method according to claim 1 wherein the electrical impact capacity applied to the well is not less than the value of P in the equation P=(1+L,1)km*100 kW/km, where L,1 is the depth of the well to the nearest 0.1 km.

3. A method according to claim 1 wherein the duration of the electrical pulse during the first stage is maintained at the following level: $T_{cl}=R_{cl}/4*\alpha$, where $R_{cl}=R_m/2$ and $R_m$ is the average pore radius in the bottom-hole zone rock (determined using a bore specimen from the bottom-hole zone), $\alpha=Y_{cl}/c_v*\rho$, where $Y_{cl}$ is the coefficient of thermal conductivity of the colmatant under the reservoir conditions, $c_v$ is the specific heat of the colmatant under the reservoir conditions, and $\rho$ is the density of the colmatant under the reservoir conditions.

4. A method according to claim 1 wherein electrical treatment of the reservoir is continued until the pulse current amplitude reaches its maximum, and its time derivative reaches zero ($dI_a/dt=0$).

5. A method according to claim 1 wherein the duration of the electrical pulse during the subsequent period of treatment is maintained at the following level: ${}_gT=R_g/4*\alpha_\Psi$, where $R_g=R_a/2$ and $R_a$ is the average radius of pores through which filtration in a given oil reservoir proceeds, $\alpha_\Psi$ is the thermal diffusivity of the reservoir water in the oil reservoir rock, $\alpha_\Psi=Y_w/c_\Psi*\rho_\Psi$, where : $Y_\Psi$ is the coefficient of thermal conductivity of the reservoir water under the reservoir conditions, $c_{p\Psi}$ is the specific heat of the reservoir water under the reservoir conditions, and $\rho_\Psi$ is the density of the reservoir water under the reservoir conditions.

6. A method according to claims 1,2,3,4 or 5, wherein the electrical treatment is discontinued once the pulse current amplitude has decreased to not less than 10% of the maximum value.

* * * * *